United States Patent [19]

Wagner

[11] 4,388,738

[45] Jun. 21, 1983

[54] MATTRESS CONSTRUCTION AND MATTRESS COVER THEREIN

[75] Inventor: Robert F. Wagner, Lombard, Ill.

[73] Assignee: Sealy, Incorporated, Chicago, Ill.

[21] Appl. No.: 237,389

[22] Filed: Feb. 23, 1981

[51] Int. Cl.[3] ..... A47C 21/00

[52] U.S. Cl. ..... 5/421; 5/462; 5/470; 5/474

[58] Field of Search ..... 5/421, 422, 460, 462, 5/470, 471, 474; 297/218, 219; 24/205.14 R, 205.14 K

[56] References Cited

U.S. PATENT DOCUMENTS

| | | | |
|---|---|---|---|
| 1,957,401 | 5/1934 | Wiedenmann | 219/46 |
| 2,162,021 | 6/1939 | Kidwell | 5/462 |
| 2,376,902 | 5/1945 | Clark | 219/46 |
| 2,517,403 | 8/1950 | Morin | 24/205.14 R |
| 2,606,996 | 8/1952 | Westerberg et al. | 219/46 |
| 2,850,617 | 9/1958 | Coldren | 5/421 |
| 2,975,437 | 3/1961 | Freeman | 5/471 |
| 3,438,069 | 4/1969 | Long | 5/422 |
| 3,493,980 | 2/1970 | Haller | 5/470 |
| 3,581,322 | 6/1971 | Marsico | 5/351 |
| 3,754,306 | 8/1973 | Cirone | 24/205.14 R |
| 3,924,284 | 12/1975 | Nelson | 5/347 |
| 4,047,254 | 9/1977 | Hamasu | 5/345 R |
| 4,047,756 | 9/1977 | Ney | 297/219 |
| 4,162,393 | 7/1979 | Balboni | 219/217 |
| 4,244,086 | 1/1981 | Gregg | 24/205.14 R |

*Primary Examiner*—Ramon S. Britts
*Assistant Examiner*—Michael F. Trettel
*Attorney, Agent, or Firm*—Hume, Clement, Brinks, Willian & Olds, Ltd.

[57] ABSTRACT

A mattress cover is provided which includes facing panel and a heat panel overlying at least a portion of the facing panel. The heat panel has an upper section, a backing section, and means for generating heat, the heat generating means being disposed between the upper and backing sections. Also provided is means for fastening the facing panel to the heat panel comprising at least one complementary pair of interlocking members comprising a first and a second locking member, the first locking member being secured to the facing panel, the second locking member being secured to the heat panel, and the first and second locking members being adjustable between an interlocked position, bridging the facing and heat panels, to an open position. The mattress cover is also provided with means for securing the facing panel to a mattress core. Also provided is a mattress construction having a mattress core and a facing panel and having said mattress cover secured to the facing panel.

20 Claims, 12 Drawing Figures

FIG. 1
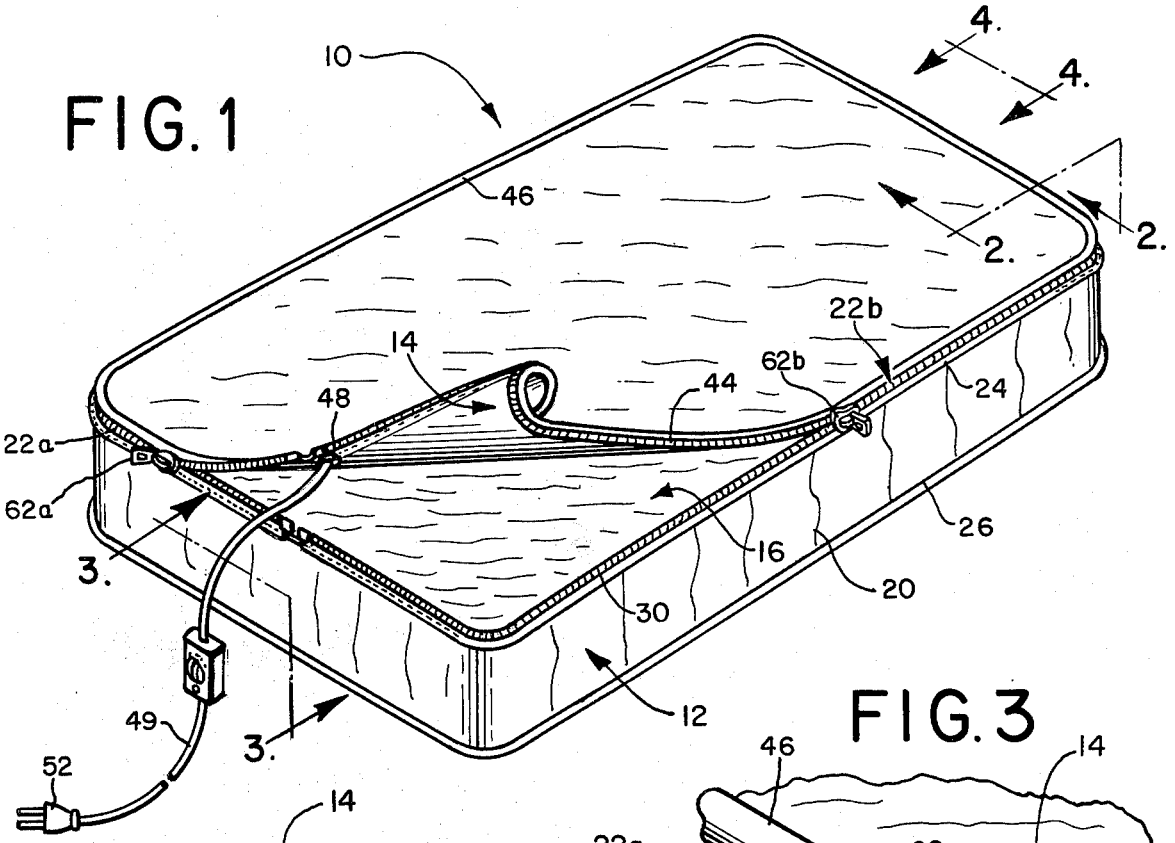
FIG. 3
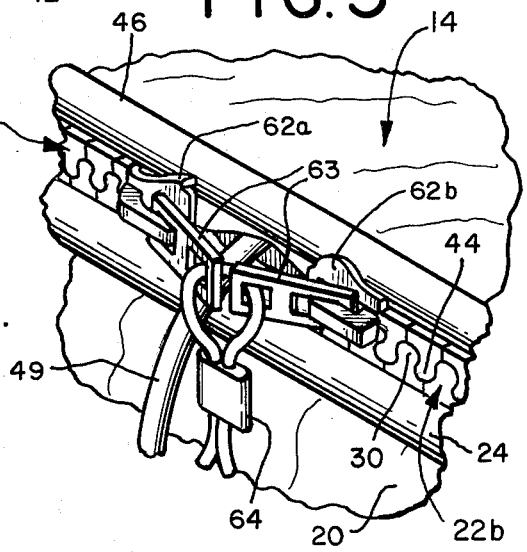
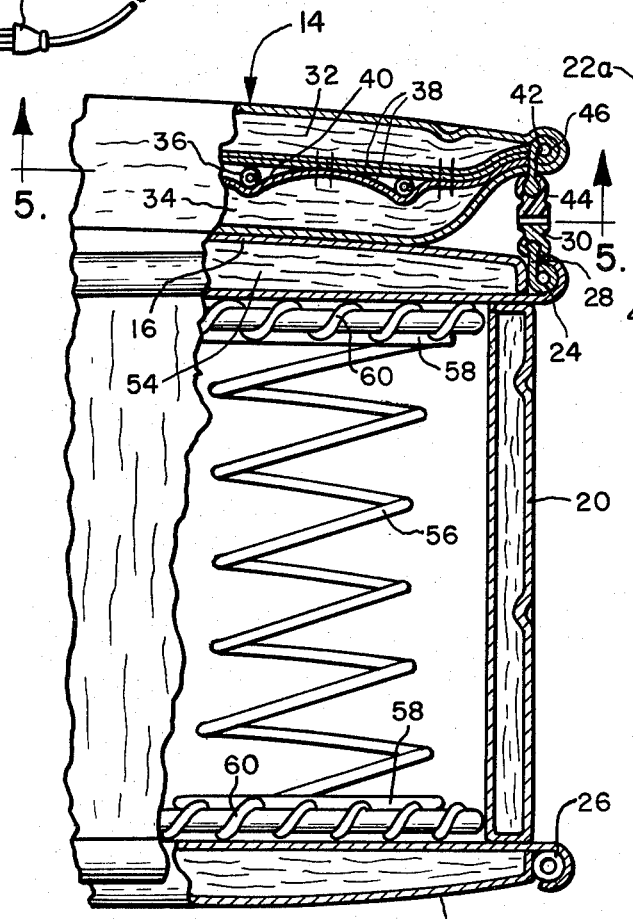
FIG. 2
FIG. 4
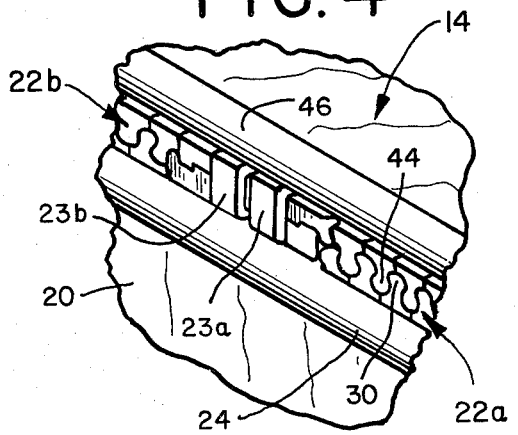

FIG. 5
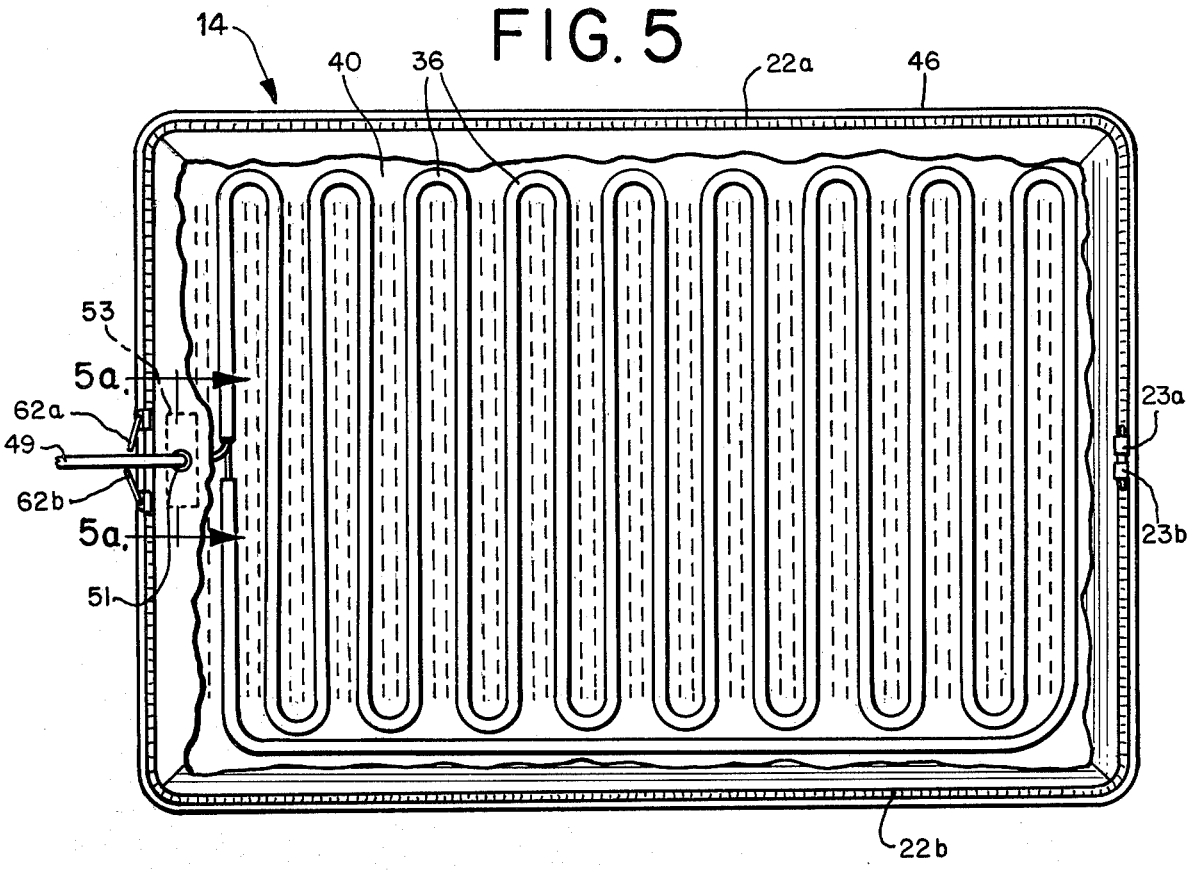
FIG. 6
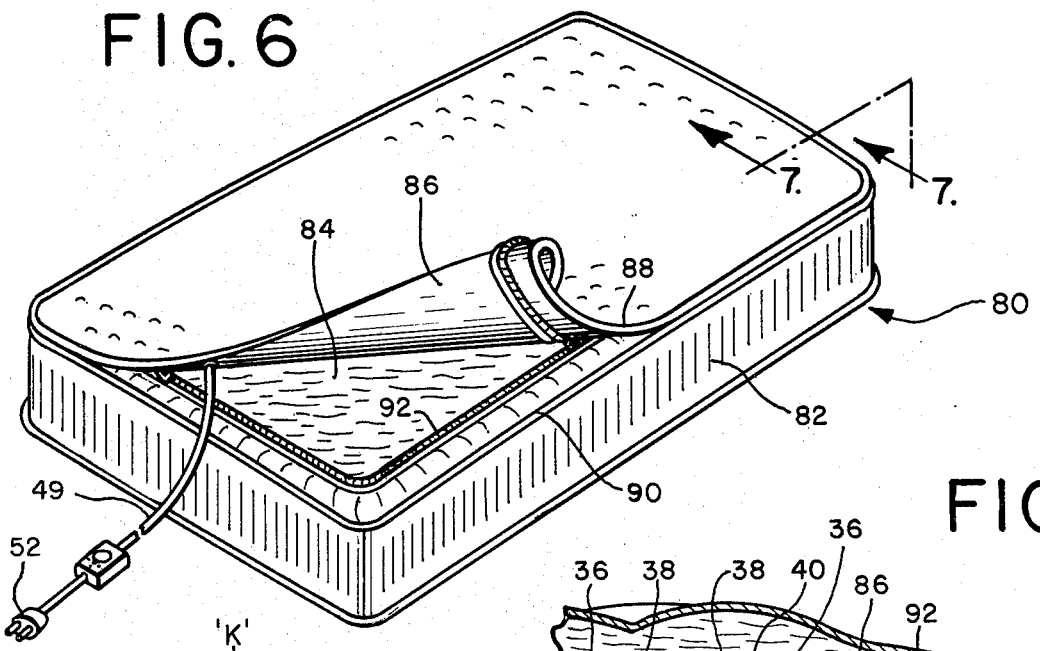
FIG. 7
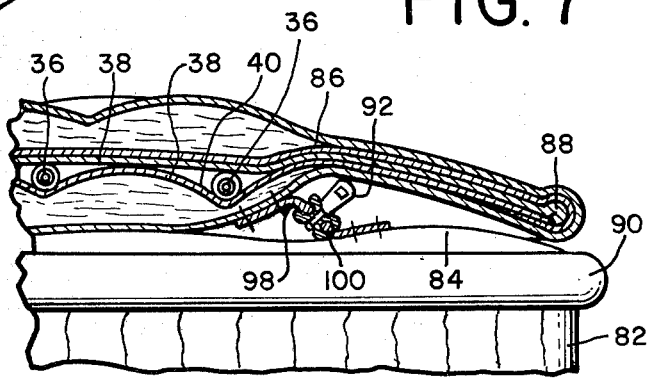
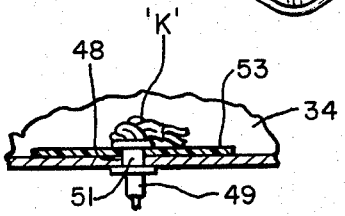
FIG. 5a

MATTRESS CONSTRUCTION AND MATTRESS COVER THEREIN

TECHNICAL FIELD OF THE INVENTION

The present invention is in the technical field of mattress constructions and mattress covers incorporated into, and forming a part of, mattress constructions, and more particularly, this invention is within the technical field of heated mattress constructions, and mattress covers incorporating into, and forming a part of, heated mattress constructions.

BACKGROUND AND GENERAL DESCRIPTION OF THE INVENTION

Mattress constructions integrated with heat generating units are known in the art. For instance, various heatable mattress constructions are disclosed in U.S. Pat. Nos. 4,162,393 (Balboni), 4,047,254 (Hamasu), 3,924,284 (Nelson), 2,606,996 (Westerberg et al.), 2,376,902 (Clark), and 1,957,401 (Wiedenmann). These patents disclose various heating units, which generally are electric resistance elements encased in layers of insulating materials that are integrated into the mattress construction. As an example, the Balboni U.S. Pat. No. 4,162,393 discloses a mattress having one or more heating pads overlying an innerspring unit and covered by a fire-retardant pad. The fire-retardant pad in turn is covered by a mattress cover which encases the entire assembly and forms an integral portion of the mattress. As another example, the Nelson U.S. Pat. No. 3,924,284 discloses a mattress having a slab core of foam rubber topped with a thermostatically controlled heating element interposed between protective pads, with a fabric cover disposed about the entire assembly. Heating units such as these are integrated with, and made a portion of, the mattress construction at least by virtue of their disposition below the mattress cover.

Heating units embedded into a mattress construction are desirable. They provide localized heat, i.e., heat which is generally localized at the sleeping surface of the mattress. This localized heat can provide a suitable sleeping temperature in the immediate environment, reducing the need to heat the entire room. This localized heat is often needed for therapeutic purposes, stimulating the blood circulation and relaxing the muscles of a body reclining on such a heated surface.

Heating units embedded into a mattress construction avoid the disadvantages of using a separate heating pad over a conventional mattress. Integrated units generally can not slide out from under a user, or bunch-up as can a separate unit. Integrated units also are generally more aesthetically pleasing. They do not require either daily removal of the heating unit during periods of non-use or, alternatively, arranging the bedding over a heating unit which generally does not blend with the lines of the mattress.

Mattresses with integrated heating units, nonetheless, have disadvantages stemming from their permancency. If the heating unit fails, the entire mattress assembly must be discarded and replaced. Alternatively, if the heating unit failure is repairable, the entire mattress assembly would have to be shipped or delivered to the repair service location, so that the heating unit can be repaired. Repair or replacement of the heating unit thus is very cumbersome when the heating unit is integral with the mattress. Such an integrated construction also tends to complicate the manufacturing process.

The present invention provides a mattress cover for a mattress, and a mattress incorporating a mattress cover, including at least one heating panel that is detachably secured to a facing panel of the mattress cover. More specifically, the invention provides a heat panel, i.e., an upper section, a backing section, and means for generating heat sandwiched therebetween, and means for removably fastening the heat panel to one of the facing panels of a mattress cover.

This invention accordingly allows the heating panel to be removed from the mattress and serviced, repaired or replaced. The entire mattress assembly thus need not be handled or replaced if a heating panel malfunctions.

Further, the heating panel is attached to a facing panel of a mattress cover in a manner which allows the mattress to be flipped and used with either side up. The heating panel hence does not interfere with the desirable practice of periodically turning a mattress to preserve its shape. In fact, the heating panel makes it convenient to turn the mattress so that the heating panel is downward in the summer and upward in the winter.

The heating panel preferably should be attachable about or close to its perimeter, in such a manner as to maintain the heating panel under tension and to well integrate the heating panel into the mattress and provide an aesthetically pleasing appearance. Also, in the preferred embodiments the heating panel is attached to the mattress and secured in a manner which makes it difficult for anyone other than an authorized service representative to remove the panel from the mattress. Unskilled people are thereby discouraged from tampering with and possibly damaging the heating elements of the panel.

ILLUSTRATIVE EMBODIMENTS

FIG. 1 is a perspective view of a mattress and mattress cover embodying the removable heating panel of the present invention;

FIG. 2 is a fragmented cross-sectional view of the mattress and mattress cover of FIG. 1, taken along line 2—2 of FIG. 1;

FIG. 3 is an enlarged view of a portion of the head of the mattress and mattress cover as viewed along the line 3—3 of FIG. 1;

FIG. 4 is an enlarged view of a portion of the foot of the mattress and mattress cover as viewed along the line 4—4 in FIG. 1;

FIG. 5 is a sectional view of the heating panel embodying features of the present invention, as viewed along the line 5—5 in FIG. 2;

Figure 8:
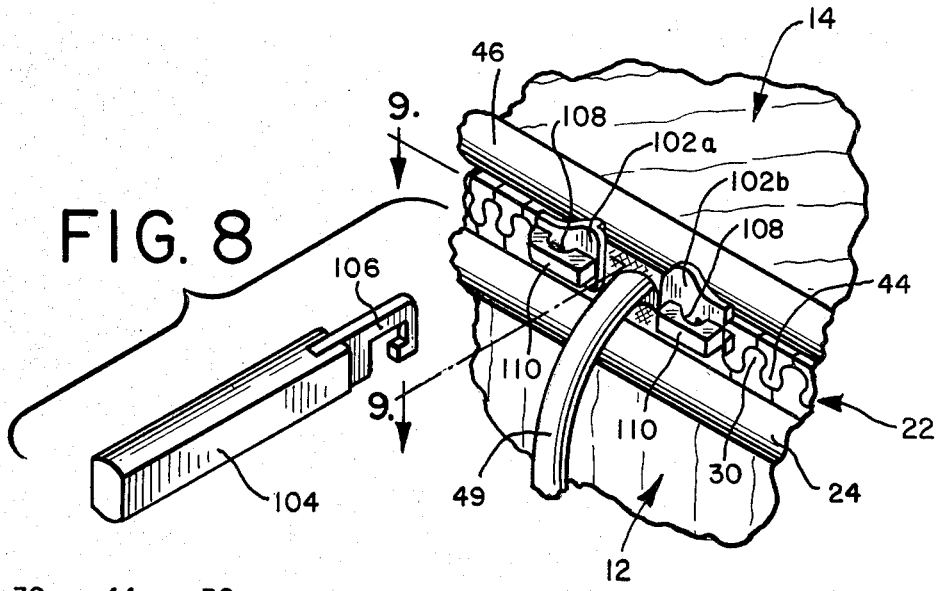
Figure 9:
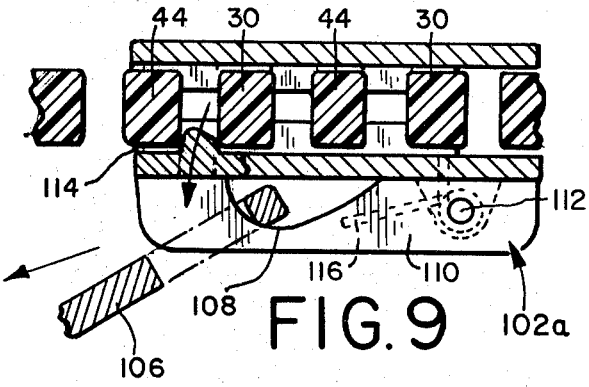
Figure 10:
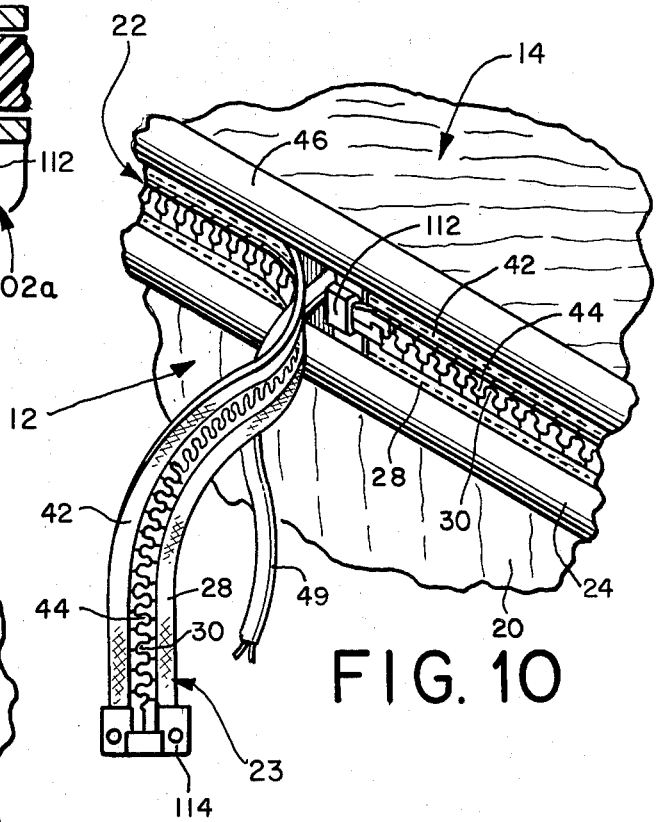
Figure 11:
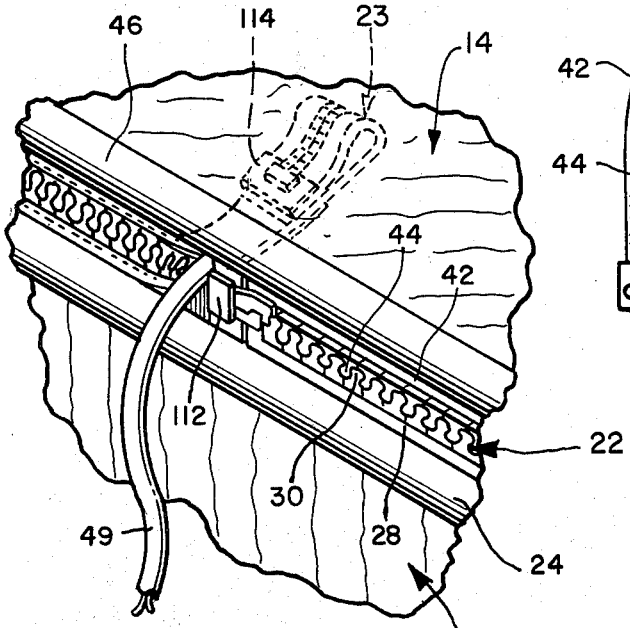

FIG. 5*a* is a removed sectional view of a portion of the heating panel, taken along the line 5*a*—5*a* in FIG. 5, showing the location of a pull stop on the electrical wires of the heating panel;

FIG. 6 is a perspective view of a mattress and mattress cover provided with a second embodiment of the heating panel in accordance with the present invention;

FIG. 7 is a cross-sectional view of the juncture between the mattress and the heating panel, as viewed along the line 7—7 in FIG. 6;

FIG. 8 is an enlarged view of a portion of the mattress illustrating one form of tool for use in removing the heating panel from the mattress in accordance with the present invention;

FIG. 9 is an enlarged cross-sectional view of the junction between the heating panel and the mattress, as seen along the line 9—9 in FIG. 8, showing the manner in which the tool releases the heating panel from the mattress;

FIG. 10 is an enlarged view of a portion of a mattress similar to FIG. 8, showing a further modification of the junction between the heating panel and the mattress before the installation of the heating panel is completed; and FIG. 11 is an enlarged view of the assembly shown in FIG. 10 illustrating the completion of the installation of the heating panel on the mattress.

The invention, as shown in FIG. 1, includes a mattress, designated generally by the reference numeral 10, which has a mattress cover, designated generally by the reference numeral 12, to which is secured a detachable heat panel, designated generally by the reference numeral 14. The mattress cover 12 is formed of an upper of first facing panel 16 and is interconnected to the heat panel 14 by a fastening means in the form of a zipper 22.

Referring now to FIG. 2 also, a border panel 20 extends between the first and second facing panels 16, 18, and covers the sides of the mattress 10, while the first and second facing panels 16, 18 cover the supportive surfaces of the mattress 10. The edges of the border panel 20 are secured to the edges of the adjacent facing panel, typically by sewing together. These interconnections are finished by enveloping in a cording cover forming cord trims 24, 26 in the perimeter edges of the mattress 10.

The zipper 22 is formed of a complementary pair of interlocking members, i.e., a first zipper ribbon 28 and zipper teeth 30 and a second zipper ribbon 42 and zipper teeth 44. One half of the zipper 22 is secured to the first facing 16 by sewing the edge of the zipper's first ribbon 28 together with the edges of the first facing panel 16 and border panel 20; positioning the zipper's first alignment of teeth 30 inward of the first cord trim 24 (See FIG. 2).

The heating panel 14 is formed of an upper section 32, a backing section 34, and heating elements 36 sandwiched therebetween. The heating elements 36 are preferably electrical resistance wires encased within suitable flexible electrical insulation material. The elements 36 are positioned between heat insulation sheets 38 and protected by a suitable deformable padding material 40.

The edges of the upper and backing sections 32, 34 of the heating panel 14 are sewn together with the edges of the insulation sheets 38 and the second ribbon 42 of the zipper 22. The zipper teeth 44 are disposed inwardly of the perimeter of the panel 14, as seen in FIG. 2. This interconnection is also encased in a cording cover to form a heat panel cord trim 46. When the first and second zipper teeth 30, 44 are aligned and interlocked, the heat panel cord trim 46 lies closely adjacent the first facing panel cord trim 24, and thus presents an appearance of a unified border edge trim.

The insulation sheets 38 need not be sewn together with other components along the edges of the heating panel. It is, however, preferred to sew the sheets 38 together with other components, as shown, so as to anchor their edges, and thus provide tension across the sheets. If the insulation sheets 38 were allowed to bunch-up or fold upon themselves, the insulation sheets 38 and the elements 36 would be more subject to cracking. Further, a bunching of the insulation sheets 38 would cause the heating elements 36 to be spaced more closely together in some areas, as compared to a uniform spacing when the insulation sheets 38 are fully extended. As a result, a bunching of the sheets 38 could cause undesirable and potentially dangerous concentrations of heat.

As seen in FIGS. 5 and 5*a*, an aperture 48 is provided in the backing section 34 of the heat panel 14. The electrical cord 49, ending in an electrical plug 52 and adapted to provide current to the heating elements 36, passes through this aperture 48 to the outside of the heating panel 14. This aperture 48 is preferably set in a distance of several inches from the second alignment of zipper teeth 44.

In the preferred embodiment of the aperture 48 is provided with a grommet 51 extending through the backing section 34 of the heating panel 14. As shown in FIG. 5*a*, a rectangular pull stop 53 is positioned inside of the section 34 in engagement with the grommet 51. By this arrangement, the provision of a simple knot "K" in the electrical cord 49, inside of the section 34, prevents the cord 49 from being pulled out of the heating panel 14. The co-operation of the knot "K" and the pull-stop 53 thereby prevents damage to the heating elements 36 from tension on the cord 49.

When the mattress 10 is an innerspring unit, as shown in FIG. 2, a mattress pad 54 underlies the first facing panel 16. Below the mattress pad 54 are a plurality of spiral coil springs 56, each having two opposed end or terminal convolutions 58. The spiral coil springs 56 are generally arranged in a plurality of rows extending head to foot of the mattress 10. The spiral coil springs 56 are interconnected to adjacent spiral coil springs 56 in the same row by cross helicals 60 that lace about adjacent terminal convolutions 58. The cross helicals 60 thus extend across the rows of spiral coil springs 56, transversely of the mattress 10.

An innerspring mattress 10 is thus symmetrical about the plane midway between its support surfaces. For even wear resulting in increased life, the mattress 10 can be turned at regular intervals so as to alternate use of its two support surfaces. Since the heating panel 14 is joined to one surface of the mattress 10, it is convenient to use the mattress with the heating panel 14 up in the winter and turned down in the summer.

The means, such as the zipper 22, for securing the heating panel 14 to the mattress facing panel 16 preferably extends about the entire periphery of the heating panel 14. This zipper 22 can be a single zipper element, or as shown in FIGS. 4 and 5, can be comprised of two zipper segments 22*a* and 22*b*. The two zipper segments 22*a*, 22*b* each have end stops 23*a* and 23*b* and closure members 62*a* and 62*b* respectively. The closure members 62*a*, 62*b* are mounted preferably on the second alignment of zipper teeth 44, and thus are attached to the heat panel 14. The closure members 62*a*, 62*b* are slideable along the teeth 44, to interlock the zipper teeth 30 and 44 and secure the edges of the heat panel 14 to the first facing panel 16 of the mattress.

As shown in FIGS. 3–5, when the zipper 22 is formed of two zipper segments 22*a*, 22*b*, the end stops 23*a*, 23*b* are disposed back-to back at the foot of the mattress. The closure members 62*a*, 62*b* substantially meet upon closure at the head of the mattress 10. The electrical cord 49 preferably passes between the closure members 62*a*, 62*b*. As seen in FIG. 3, the closure members 62*a*, 62*b* are provided with pull tabs 63 and a locking means 64 for locking the tabs together. The locking means 64 allows passage of the cord 49 between the closures 62*a*, 62*b*, but must be destroyed to move the closures. The heating panel 14 is thus secured to the mattress 10, but can be removed for repair or replacement by an authorized service representative.

Referring to FIG. 5, the electrical heating elements 36 can be formed as a single resistance wire 36 laid out in a serpentine configuration, i.e., running transversely across the mattress 10. The area encompassed by the serpentine configuration of the resistance wire 36 is preferably set-in from the edges of the heating panel 14. For heating panels 14 substantially coextensive with the support surface of a standard size mattress, a set in distance of 10 to 20 inches is sufficient. In a preferred embodiment, a set-in distance of 12 to 16 inches from the side edges of the heat panel 14, and a set-in distance of 15 to 19 inches from the head and foot edges of the heat panel, are provided. For instance, in a preferred embodiment with a heat panel 14 having dimensions of 39 by 80 inches along the trim, the electrical resistance wire 36 should be preferably confined to a centered area of 25 inches by 63 inches. For such embodiment, a 2 to 4 inch spacing between segments of the serpentine configuration is preferred, and a 3 inch spacing is optimum.

It has been found that 43 total watts in a 120 volt line, in such a configuration, provide a desired degree of heat for the panel 14.

FIGS. 6 and 7 show a second embodiment of the invention. There a mattress 80 having a mattress cover 82, with a first facing panel 84 covering the upper support surface of the mattress 80, is provided with a heat panel 86. The heat panel 86 is of suitable dimensions so that the heat panel cord trim 88 substantially meets the first facing panel cord trim 90. A zipper 92 is provided with a first and second row of zipper teeth on first and second zipper ribbons 98, 100. In this embodiment the zipper ribbons 98, 100 are not sewn into the cord trims 88, 90. Instead, the zipper ribbon 98 is secured to the back section of the heating panel 86 inwardly from the cord trim 88. Likewise, the zipper ribbon 100 is secured to the mattress facing panel 84 inward of its edge. This second embodiment thereby recesses the zipper 92 out of view under the heat panel 86.

FIGS. 8 and 9 illustrate a further modification of the invention disclosed in FIGS. 1–5. In this embodiment the ends of the zippers **22*a* and 22*b* at the head of the mattress 10 are provided with modified slide closures 102*a* and 102*b*. As compared to the closures 62*a* and 62*b* shown in FIG. 3, the closures 102*a* and 102*b* do not have a pull tab comparable to the tab 63. Instead, a tool 104 is provided to release and slide the closures 102*a* and 102*b* on the respective zippers 22*a* and 22*b***.

A hook element 106 is provided on one end of the tool 104 to engage with the closures **102*a* and 102*b* during the releasing operation. As seen in FIG. 9, the hook 106 can be extended into an opening 108 provided on a locking member 110 in each closure 102*a* and 102*b*. Each closure locking member 110 is pivoted on a pin 112 at one end, and is provided with a detent 114 at the other end. A spring 116 or other suitable means normally biases the detent 114 into engagement with the teeth 30, 44 of the zipper 22*a*. However, a pulling force on the tool 104 and hook 106, in the direction of the arrow in FIG. 9, releases the detent 114 from the zipper teeth 44. The closure 102*a* then can slide to open the zipper 22*a* and remove the heating panel 14 from the mattress 10. Of course, the other closure 102*b* is operated by the tool 104** in the same manner.

The embodiment shown in FIGS. 8 and 9 eliminates the need for seal 64 or the like, and prevents the heating panel 14 from being removed from the mattress 10 by the normal user by removing the pull tabs from the sliding closures **102*a* and 102*b*. The heating panel 14 can be removed for service or replacement by an authorized service representative who has a tool 104**.

FIGS. 10 and 11 illustrate a further embodiment of the invention which also prevents the heating panel 14 from being tampered with or removed by unauthorized persons. In this embodiment the zipper 22 is continuous around the periphery of the mattress 10. The initial or starting end of the zipper 22 is provided with a standard stop 112. A closure element, similar in all respects to elements **62*a* and 62*b* shown in FIG. 3, is used to join the two halves of the zipper 22** in the normal manner.

As seen in FIG. 10, the trailing end of the zipper 22 defines a free tail portion 23 of substantial length (e.g. 12 to 18 inches). In this embodiment the closure joins the two halves of the zipper 22 throughout this tail portion 23. The zipper tape comprising the tail 23 is then cut, and the closure removed. Next, a second end stop 114 is applied to the tail portion 23 of the zipper, to lock the zipper 22 in a closed position.

As seen in FIG. 11, this closed tail portion 23 can be tucked under the heating panel 14 during normal use of the mattress 10. The electrical cord 49 is readily extended between end stop 112 and the zipper tail end 23. If the heating panel 14 must be removed, an authorized service representative can pull out the tail 23 and cut the end stop 114 from the tail. A slide closure then can be applied to open the zipper 22 and remove the heating panel 14.

Although the invention has been described above with a certain degree of particularity, it should be understood that this disclosure is made only by way of example. Consequently, numerous changes in the details of construction and in the combination and arrangement of the components, as well as in the possible modes of utilization, will be apparent to those familiar with the art, and may be resorted to without departing from the scope of this invention as claimed.

I claim:

1. A mattress cover comprising:

a facing panel;

a heat panel overlying at least a portion of said facing panel, said heat panel comprising an upper section, a backing section, and means for generating heat, said heat generating means disposed between said upper and backing sections;

means for fastening said facing panel to said heat panel comprising at least one complementary pair of interlocking members comprising a first and a second locking member, said first locking member being secured to said facing panel, and second locking member being secured to said heat panel, and said first and second locking members being adjustable between an interlocked position, bridging said facing and heat panels, and an open position; and means for securing said facing panel to a mattress core.

2. The mattress cover of claim 1 wherein said complementary pair of interlocking members comprises a first and second alignment of interlocking teeth and a closure member, said closure member being slideably mounted on at least one of said alignments of interlocking teeth and being operable to interlock and release said teeth upon reciprocal sliding.

3. The mattress cover of claim 2 wherein said first alignment of teeth is secured substantially closely adjacent the peripheral edge of said facing panel and said second alignment of teeth is secured substantially closely adjacent the peripheral edge of said heat panel.

4. The mattress cover of claim 2 wherein said first alignment of teeth is secured inward from the peripheral edge of said facing panel.

5. The mattress cover of claim 3 or 4 wherein said fastening means comprises two complementary pairs of alignments of interlocking teeth and respective reciprocally sliding closure members.

6. The mattress cover of claim 5 wherein said two reciprocally sliding closure members meet when said two complementary pairs of alignments of teeth are interlocked.

7. The mattress cover of claim 6 wherein said closure members include pull tab means for gripping and sliding said members along said teeth and further including means for releasably interlocking said pull tab means of said two closure members when said two complementary pairs of alignments of teeth are interlocked.

8. The mattress cover of claim 6 wherein each closure member includes retractable detent means engage with said teeth and pull tab means operative to retract said detent means from engagement with and to slide said members on said teeth, said pull tab means further being removable from said closure member to prevent sliding of said member by locking said detent means into engagement with said teeth.

9. The mattress covering of claim 3 or 4 wherein said fastening means comprises a pair of ribbons of complementary interlocking teeth having one end provided with stop means to secure said one end of said ribbons together and further having a closure member adapted to slide on said ribbons and interlock said teeth and further adapted to be removed from said ribbons to prevent said teeth from unlocking.

10. The mattress covering of claim 9 wherein said ribbons of interlocking teeth include a second end which overlaps the first end by a selected distance and is provided with a second stop means securing said second end of said ribbons together.

11. A mattress construction comprising:

a mattress core having at least one support surface;

a facing panel overlying said support surface;

a heat panel overlying at least a portion of said facing panel, said heat panel comprising an upper section, a backing section, and means for generating heat, said heat generating means disposed between said upper and backing section;

means for fastening said facing panel to said heat panel comprising at least one complementary pair of interlocking members comprising a first and a second locking member, said first locking member being secured to said facing panel, said second locking member being secured to said heat panel, and said first and second locking members being adjustable between an interlocked position, bridging said facing and heat panels, and an open position; and means for securing said facing panel to said mattress core.

12. The mattress construction of claim 11 wherein said complementary pair of interlocking members comprises a first and second alignment of interlocking teeth and a closure member, said closure member being slideably mounted on at least one of said alignments of interlocking teeth and being operable to interlock and release said teeth upon reciprocal sliding.

13. The mattress construction of claim 12 wherein said first alignment of teeth is secured substantially closely adjacent the peripheral edge of said facing panel and said second alignment of teeth is secured substantially closely adjacent the peripheral edge of said heat panel.

14. The mattress construction of claim 12 wherein said first alignment of teeth is secured inward from the peripheral edge of said facing panel.

15. The mattress construction of claim 13 or 14 wherein said fastening means comprises two complementary pairs of alignments of interlocking teeth and respective reciprocally sliding closure members.

16. The mattress construction of claim 15 wherein said two reciprocally sliding closure members meet when said two complementary pairs of alignments of teeth are interlocked.

17. The mattress construction of claim 16 further including means for interlocking said two closure members when said two complementary pairs of alignments of teeth are interlocked.

18. The mattress construction in accordance with claim 16 wherein each closure member includes retractable detent means engage with said teeth and pull tab means operative to retract said detent means from engagement with and to slide said members on said teeth, said pull tab means further being removable from said closure member to prevent sliding of said member by locking said detent means into engagement with said teeth.

19. The mattress construction in accordance with claim 13 or 14 wherein said fastening means comprises a pair of ribbons of complementary interlocking teeth having one end provided with stop means to secure said one end of said ribbons together and further having a closure member adapted to slide on said ribbons and interlock said teeth and further adapted to be removed from said ribbons to prevent said teeth from unlocking.

20. The mattress construction in accordance with claim 19 wherein said ribbons of interlocking teeth include a second end which overlaps said first end a selected distance to define a free end of said ribbons; and second stop means securing said second end of said ribbons together; whereby said free ends of said ribbons is adapted for storage between said facing panel and heat panel and can be cut to allow said teeth on said ribbons to be unlocked.

* * * * *

UNITED STATES PATENT AND TRADEMARK OFFICE

CERTIFICATE OF CORRECTION

PATENT NO. : 4,388,738

DATED : June 21, 1983

INVENTOR(S) : Robert F. Wagner

It is certified that error appears in the above-identified patent and that said Letters Patent is hereby corrected as shown below:

In the Abstract, line 1, delete "facing" and insert --a facing--.

At column 2, line 46, delete "of" and insert --in--.

At column 3, line 18, delete "of" and insert --or--.

At column 4, line 12, delete "of".

At column 4, line 59, delete "back-to back" and insert --back-to-back--.

At column 5, line 10, delete "set in" and insert --set-in--.

At column 6, line 52, delete "and" and insert --said--.

At column 7, line 7, delete "claim" and insert --claims--.

At column 7, line 22, delete "engage" and insert --engaged--.

At column 7, line 29, delete "claim" and insert --claims--.

At column 7, line 49, delete "section" and insert --sections--.

UNITED STATES PATENT AND TRADEMARK OFFICE

CERTIFICATE OF CORRECTION

PATENT NO. : 4,388,738

DATED : June 21, 1983

INVENTOR(S) : Robert F. Wagner

It is certified that error appears in the above-identified patent and that said Letters Patent is hereby corrected as shown below:

At column 8, line 21, delete "claim" and insert --claims--.

At column 8, line 35, delete "engage" and insert --engaged--.

At column 8, line 43, delete "claim" and insert --claims--.

At column 8, line 56, delete "is" and insert --are--.

Signed and Sealed this

*Twenty-seventh* Day of *March 1984*

[SEAL]

*Attest:*

GERALD J. MOSSINGHOFF

*Attesting Officer*

*Commissioner of Patents and Trademarks*